US005090596A

United States Patent [19]

Knight

[11] Patent Number: 5,090,596

[45] Date of Patent: Feb. 25, 1992

[54] PLASTIC PERFORATIVE SPOUT DEVICE

[76] Inventor: Robert W. Knight, 39 N. San Mateo Dr., San Mateo, Calif. 94402

[21] Appl. No.: 756,986

[22] Filed: Sep. 9, 1991

[51] Int. Cl.[5] ..... B67D 5/00; B67D 3/00

[52] U.S. Cl. ..... 222/91; 222/517; 222/556

[58] Field of Search ..... 222/80, 81, 83, 89, 222/90, 91, 153, 507, 511, 517, 556, 505; 251/89, 111, 114

[56] References Cited

U.S. PATENT DOCUMENTS

| | | | |
|---|---|---|---|
| 1,209,438 | 12/1916 | Houston | 222/91 |
| 1,998,586 | 4/1935 | Maggenti | 222/91 |
| 2,414,911 | 1/1947 | Temple | 222/81 |
| 3,306,563 | 2/1967 | Soto | 222/81 X |
| 3,333,737 | 8/1967 | Molineux | 222/91 |
| 3,369,708 | 2/1968 | Hein | 222/89 X |
| 3,549,049 | 12/1970 | Weber | 222/91 |
| 4,322,018 | 3/1982 | Rutter | 222/90 X |
| 4,623,077 | 11/1986 | Swartzbaugh | 222/517 |
| 4,645,100 | 2/1987 | Wells | 222/517 X |
| 4,669,640 | 6/1987 | Ando et al. | 222/556 X |

FOREIGN PATENT DOCUMENTS

| | | | |
|---|---|---|---|
| 1245782 | 7/1967 | Fed. Rep. of Germany | 222/91 |

*Primary Examiner*—Kevin P. Shaver

*Attorney, Agent, or Firm*—Janet K. Castaneda

[57] ABSTRACT

A plastic perforative spout for dispensing substances through a sidewall of a plastic container includes a unitary rigid plastic, preferably teflon or polyethylene, perforation element with a protective cap, a dispensing valve removably attached to the perforation element, and an accessory circular adaptor for rounded containers. The plastic cutting element extends from a hollow shank surrounding an opening in a flange portion of a hollow tubular body. Two intersecting cross ribs are formed inside the shank, and a vertical rib extends from the intersection of the cross-ribs to the point of the radius cut semi-circular cutting element. The plastic dispenser is removably attached over the tubular body, and a boss is pressed to displace the flexible concave valve to dispense the container contents through the mouth of the dispenser. A snap lock holds the valve open if desired. The circular adaptor fits over the shank and defines a concave surface for mounting flush against a curved surface. Options include swaged metallic blades and metallic plating for the plastic blades.

13 Claims, 4 Drawing Sheets

PLASTIC PERFORATIVE SPOUT DEVICE

FIELD OF THE INVENTION

The present invention relates to a device for forming an opening through the wall of a container for dispensing the contents therefrom. More particularly, the device is a plastic perforative member with a removable dispenser attached thereto for dispensing a substance through the wall of a plastic container.

BACKGROUND OF THE INVENTION

The metallic perforative spout is known in the art. Such devices typically include a pointed cutting element such as a single curved blade or multiple blades for making an opening in a wall of a container. The cutting element may be attached to a dispensing element. Prior art metallic spout devices have been described for use with metallic containers, paper containers, and thin-walled plastic containers.

Three such perforative spout devices for gaining access to metallic containers are described in the Maggenti U.S. Pat. No. 1,992,320; the Disher U.S. Pat. No. 1,088,332; and Temple U.S. Pat. No. 2,414,911.

Weber U.S. Pat. No. 3,927,803 describes a metallic perforative spout for use with thin-walled containers made from a variety of materials. Rosenberg U.S. Pat. No. 2,015,158 describes a perforative bottle tap for metallic bottle tops. Kato U.S. Patent describes a thrusting cock for paper containers.

A heretofore unrecognized need exists in the industry for a plastic perforative spout device for plastic containers.

SUMMARY OF THE INVENTION WITH OBJECTS

A general object of the present invention is to provide a plastic perforative spout device that overcomes the disadvantages and limitations of the prior art.

A specific object of the present invention is to provide a plastic perforative spout device having a plastic cutting element with a protective cover and a removable dispenser element for dispensing a substance from the wall of a plastic container.

Another specific object of the present invention is to provide a plastic perforative spout device with an optional adaptor for use with generally circular plastic containers.

Yet another specific object of the present invention is to provide a perforative spout made from plastic materials, for example teflon and polyethylene, which comply with regulations for direct food contact, such as USDA, FDA and Food Additive Regulations.

Still one more specific object of the present invention is to provide a plastic perforative spout with a metallic cutting element, or alternatively, with a metallic coated plastic cutting element.

In accordance with the present invention, a plastic perforative spout device is provided for dispensing a substance through the wall of a plastic container. The device includes a perforation element with a removable protective cap, a dispensing element removably attached to the perforation element, and an accessory circular adaptor.

The perforation element is preferably of unitary, molded construction from a food safe plastic material, and defines a cutting element and a body.

The generally circular body defines a hollow tubular duct having a collar at a first end and a flange at the opposite end. The flange defines a central opening communicating with the interior of the hollow duct. The cutting element includes a hollow threaded shank surrounding and extending outwardly from the central opening in the flange, thereby generally axially aligned and communicating freely with the hollow interior of the duct. The single thread of the shank spirals upwardly to terminate at a circular rim.

Two cross-ribs intersect at a generally 90 degree angle to form generally a cross pattern spanning the length and breadth of the hollow interior of the shank.

A semi-circular blade mechanism extends outwardly from one half of the circular rim and gradually tapers to form a sharp point for piercing the wall of the container. The point is generally centered above the circular rim. Each radius cut, curved edge of the concave semi-circular cutting element forms a blade.

A radius cut vertical rib extends upwardly from the intersection of the two cross-ribs through the semi-circular blade mechanism to terminate within the point. The cross-ribs and the vertical rib prevent the resultant plug cut from the wall of the container from clogging the flow passage of the perforative spout device.

A generally cylindrical, snap-on or threaded protective cap is provided for placement over the cutting element.

The dispensing element removably attaches over the duct of the body between the rim and the flange. The dispensing element is a conventional spout made of a resilient plastic material having a concave displaceable valve surrounding the edge of an annular wall. A boss on the valve is manually manipulated to release the periphery of the diaphragm from the rim of the duct thereby forming an opening between the duct and the dispenser outlet in the wall. A lock-open mechanism is provided to permit the user to leave the dispenser unattended during dispensing operations.

The removable adaptor for circular containers mounts over the shank flush against the flange of the body, the adaptor includes a planar mounting surface and a concave face for placement against the rounded outer surface of the container.

In a second aspect of the present invention, the blade element is plated with a metallic coating.

In a third aspect of the present invention, a metal blade is swaged or molded onto the perforative spout device.

These and other objects, aspects, advantages and features of the present invention will be more fully understood and appreciated upon consideration of the following detailed description of a preferred embodiment, presented in conjunction with the accompanying drawings.

DETAILED DESCRIPTION OF A PREFERRED EMBODIMENT

Figure 1:
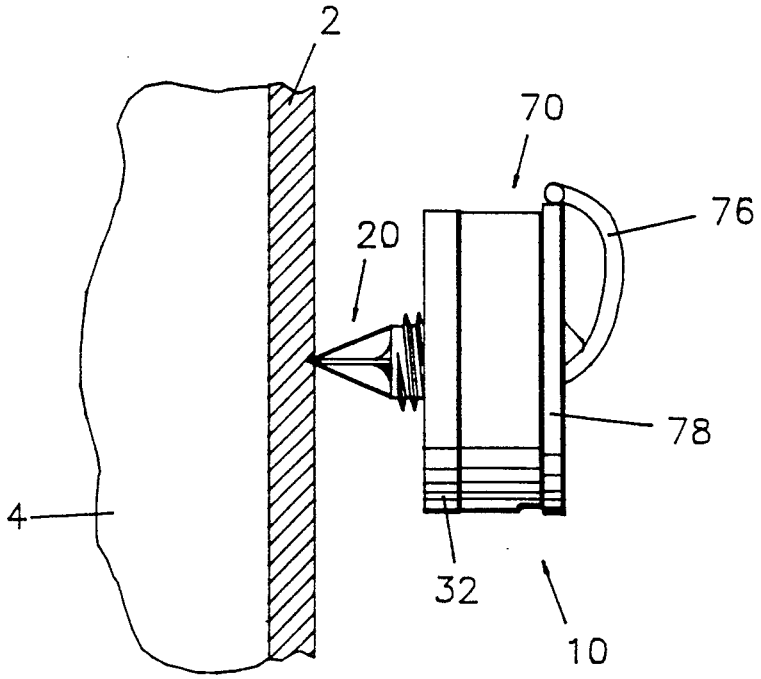
FIG. 1 is a side view of the plastic perforative spout device of the present invention with the point of the blade element contacting the wall of a container shown in section.
Figure 5:
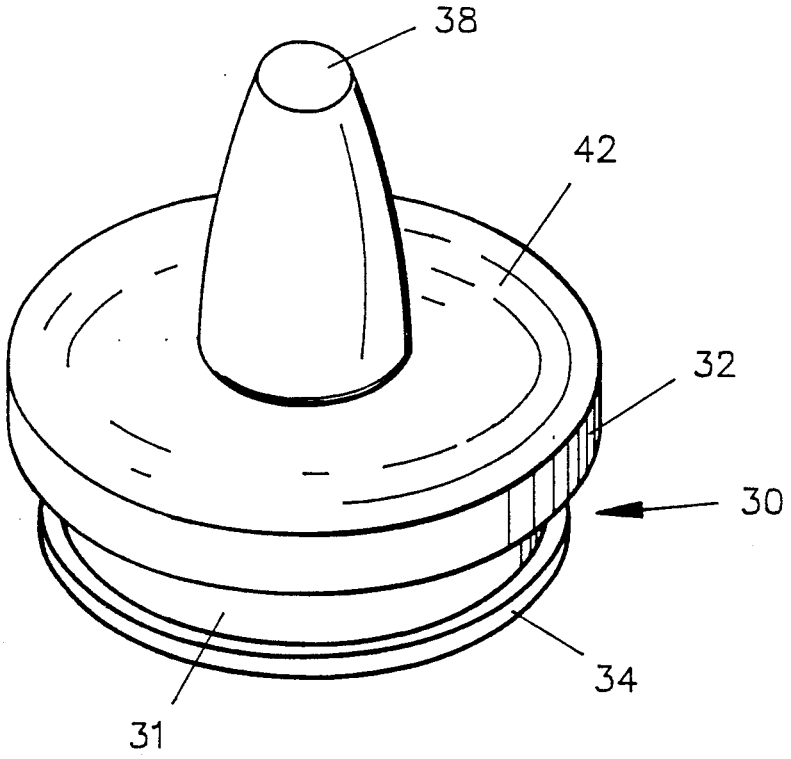
FIG. 5 shows the removable protective cap placed over the cutting element of FIG. 3.
Figure 6:
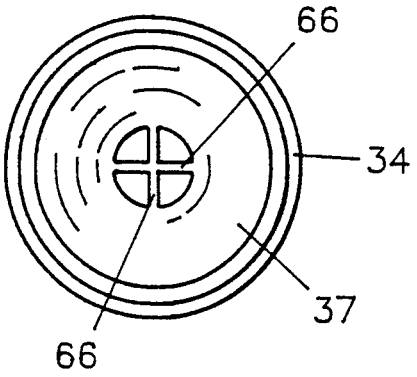
FIG. 6 is a bottom view of the body showing the interior of the duct, the central opening in the flange, and the two cross-ribs in the shank.

A plastic perforative spout device 10 demonstrating the principles of the present invention is shown in FIG. 1 generally at 10. The perforative spout device 10 is shown positioned prior to perforation of a wall 2 of a plastic container 4. The perforative spout device 10 includes a perforation element shown generally at 20, a protective cap 38 (shown in FIG. 5), a dispensing element shown generally at 70, and a circular adaptor 80 (shown in FIG. 8).

Figure 3:
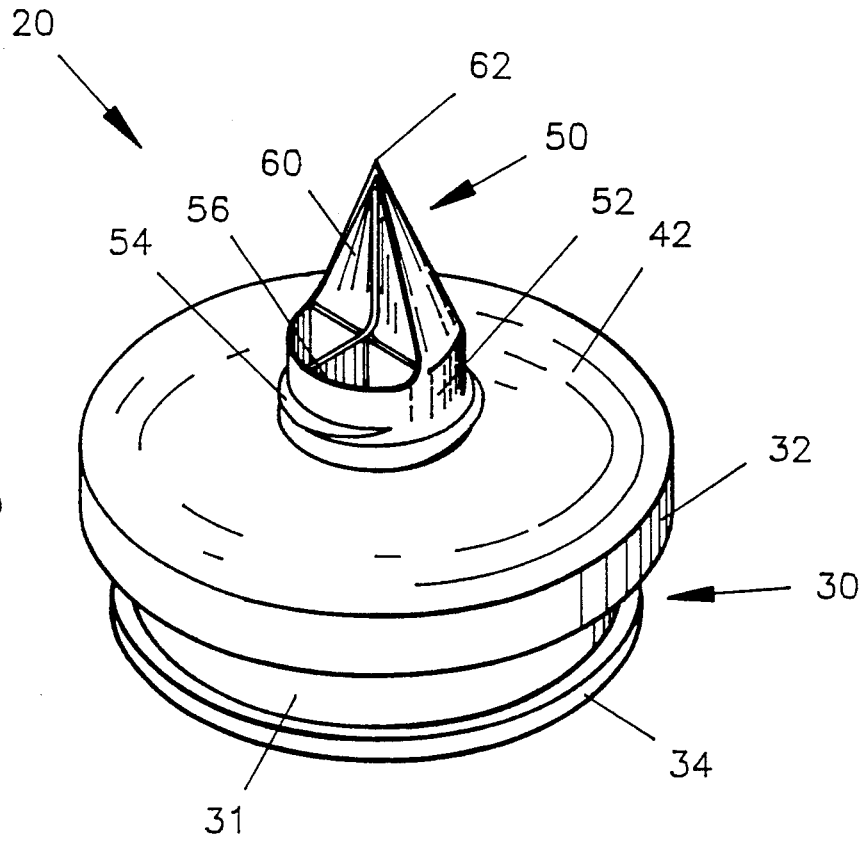
FIG. 3 is a top plan view of the perforation element showing the duct, the flange, and the cutting element.
Figure 4:
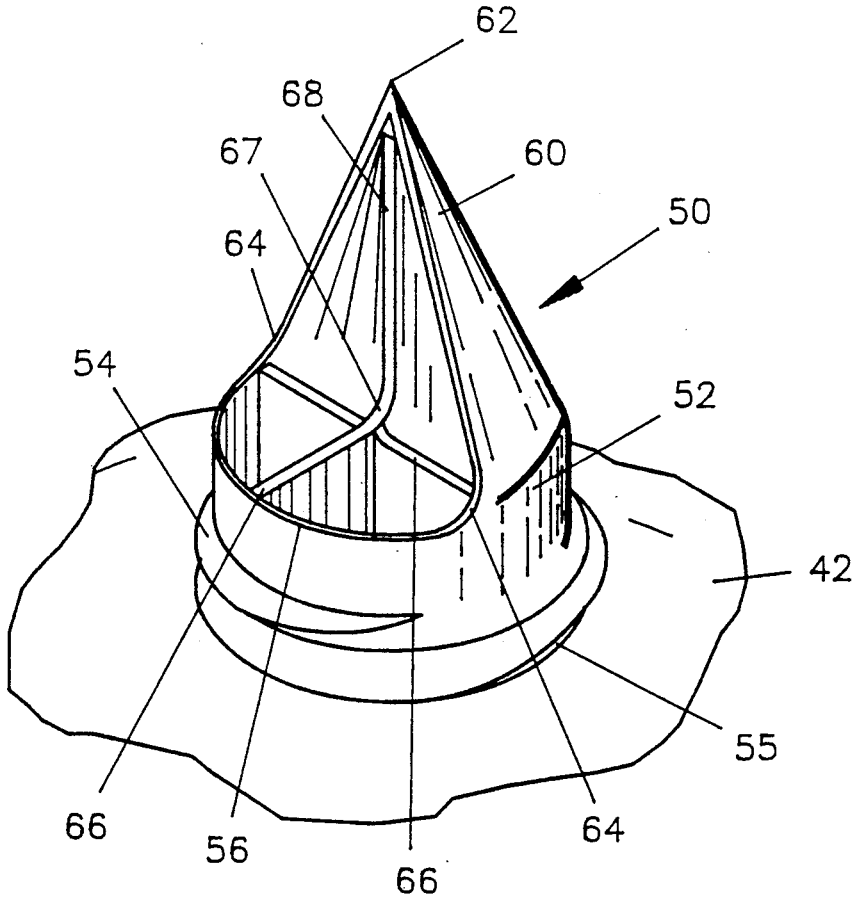
FIG. 4 is an enlarged view of the cutting element of FIG. 3 showing the blade, cross ribs, and vertical rib.

Referring now to FIGS. 3 and 4, the perforation element 20 is preferably a unitary structure molded or cast from a rigid, food safe plastic material, such as polyethylene or teflon, that complies with regulations such as those of the USDA, FDA and Food Additive Regulations for direct food contact. The specifications for the plastic material include a normal, high or ultra-high molecular weight sufficient to provide hardness, abrasion resistance, and high impact and tensile strength. Additionally, the plastic material should demonstrate a low coefficient of friction, a high tear and shear strength, and a Young's modulus of at least approximately 50,000 psi. Preferably, the unitary element 20 is made by extrusion molding. The element 20 may also be made of machined stainless steel of a unitary construction.

The unitary perforation element 20 defines a body portion 30 and a cutting element portion 50. The generally circular body 30 defines a hollow tubular portion 31 having a flange 32 at one end and a collar 34 at the opposite end. The flange 32 preferably includes a planar surface 42 and defines a generally central opening 36 communicating with an interior space 37 of the hollow tubular portion 31.

Figure 2:
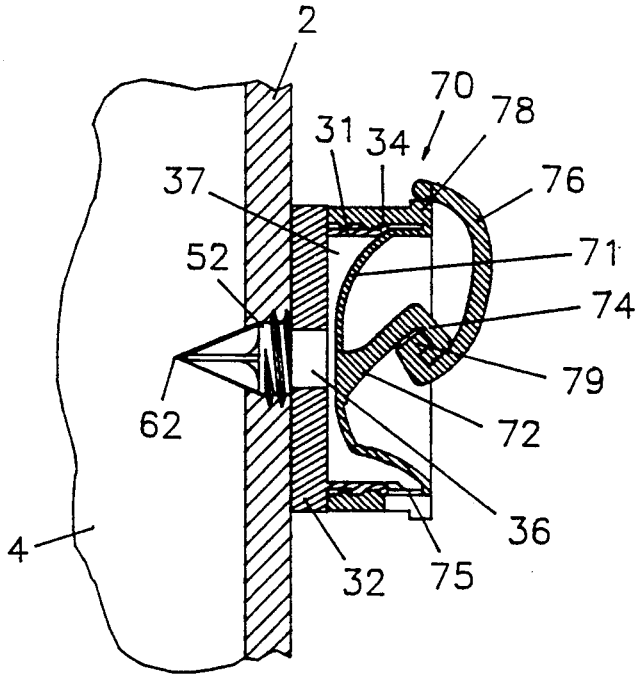
FIG. 2 is a sectional view of the emplaced plastic perforative spout device of FIG. 1 showing the dispenser and flow passage for the contents of the container.

Referring now to FIGS. 2 and 4, the cutting element portion 50 of the perforation element 20 includes a hollow threaded tubular shank 52 extending from and surrounding the central opening 36 in the flange 32, thereby aligned with and communicating freely with the hollow interior space 37 of the tubular portion 31. The single thread 54 forms an angled spiral ascending from the base 55 of the threaded shank 52 to terminate at a circular rim 56.

A semi-circular, generally hollow, curved blade mechanism 60 extends from a radius cut in one half of the rim 56 to define a generally central point 62 for piercing the wall 2 of the plastic container 4. Each curved edge 64 of the concave semi-circular blade mechanism 60 defines a sharp cutting blade. Two cross-ribs 66 intersect at a generally 90 degree angle to form a cross pattern spanning the diameter and the length of the tubular shank 52. A radius cut vertical rib 68 extends upwardly from the intersection 67 of the cross ribs 66 and inside of the semi-circular blade mechanism 60 to the point 62. The ribs 66 and 68 prevent the resultant plug cut from the wall 2 of the container 4 from clogging the flow passage 36 of the perforative spout device 10. A generally cylindrical, snap-on protective cap 38 is provided for the blade mechanism 60 (see FIG. 5).

The blade mechanism 60, or the cutting edges 64, may be metal plated if desired. In addition metallic cutting blades my be swaged or molded into the plastic perforation element during formation.

Figure 7:
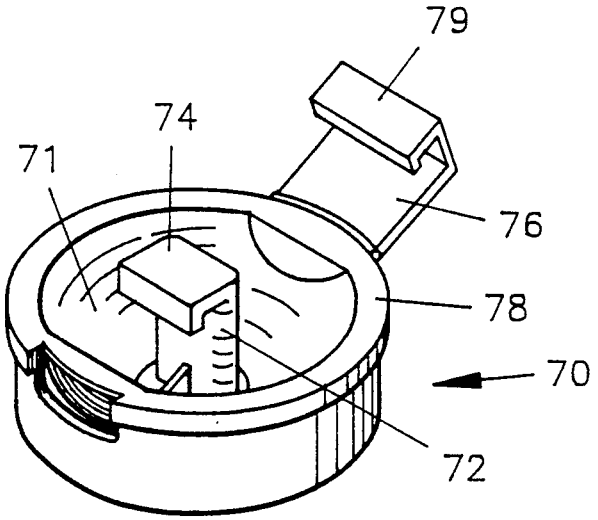
FIG. 7 is top plan view of the dispensing element and lock mechanism.

Referring now to FIGS. 2 and 7, the dispensing element 70 is removably attached over the tubular portion 31. The resilient plastic dispensing element 70 includes a conventional concave pressure valve 71 communicating with the interior 37 of the tubular portion 34. The manually operated valve 71 includes a operating boss 72 further defining a snap-lock bracket 74. A lock 76 is hinged to a flange 78 and includes a mating lock bracket 79. As best shown in FIG. 2, when the operating boss 72 is pushed and/or locked in place, the contents of the container 4 may flow through the shank 52, through the opening 36, through the interior space 37, and out of the dispenser 70 through an outlet 75.

Figure 8:
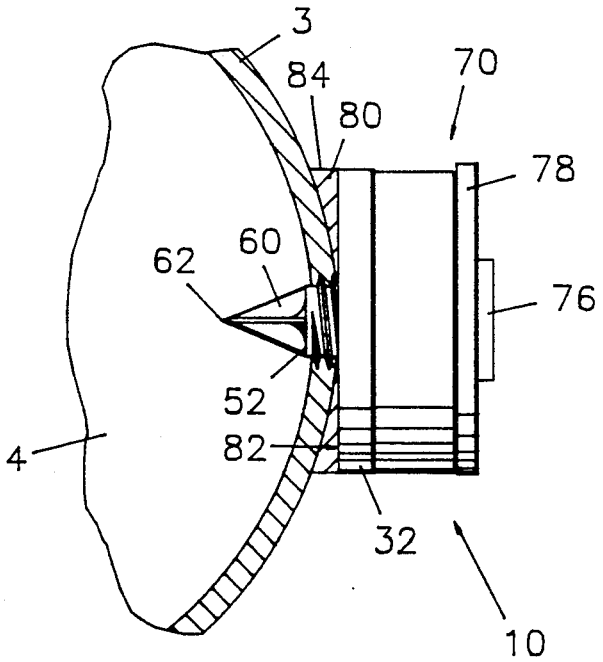
FIG. 8 shows the adaptor placed between the flange and the sectioned wall of a circular container.

Referring now to FIG. 8, a removable adaptor 80 is provided for containers having rounded or circular walls 3. The adaptor 80 mounts over the threaded shank 52 and includes a planar flange surface 82 mounted flush to the flange 32. A concave surface 84 secures the perforative spout device 10 to the rounded outer surface of the wall 3 of the container 4.

To emplace the perforative spout device, the pointed tip 62 of the blade element 60 is used to pierce the plastic wall 2 of the container 4. The user then rotates the device 10 to cause the cutting surface 64 to cut out a circular segment of the plastic wall 2. The cross ribs 66 and the vertical rib 68 prevent the plug from clogging the flow passage. Once a hole has been formed, the thread 54 engages the wall 2 as the user continues to rotate the spout device 10. The angled thread 54 causes the spout device 10 to be threaded onto the plastic wall 2 and forms a liquid-tight seal. Once the perforative spout is in place and the flange is flush against the wall 2 of the container 4, the dispenser may be operated to dispense the contents from the container 4 as desired. Following use, the perforative spout is removed, cleaned, and reused as desired.

Although the presently preferred embodiment of the invention has been illustrated and discussed herein, it is contemplated that various changes and modifications will be immediately apparent to those skilled in the art after reading the foregoing description in conjunction with the drawings. For example, the flange may be curved as opposed to planar for curved container surfaces thereby eliminating the need for an adaptor. Other locking mechanisms may be provided for the dispensing element, and the cross-rib number and arrangement may be varied.

What is claimed is:

1. A plastic perforative spout device for dispensing a substance through the wall of a plastic container, the device comprising in combination:

a unitary plastic perforation element comprising a body portion and a cutting portion, the body portion defining a tubular section and a flange at a first end thereof, the flange defining an aperture therethrough to an interior space of the tubular section; the cutting portion defining a shank and a cutting element, the shank surrounding the aperture and having an exterior thread means and an interior passageway communicating with the interior space of the tubular section, the interior passageway including at least one cross rib, the cutting element extending from a rim of the shank and tapering to a sharp point, the cutting element defining two edge blades, a vertical rib extending from said at least one cross rib to the sharp point;

a plastic dispenser comprising: a wall removably attached over an exterior surface of the tubular section, a concave flexible valve means secured around the wall, a boss attached to the valve means for operating said valve means, lock means for locking the valve in an open position, said lock means including a first locking element on said boss and a mating lock means hinged to the wall, operation of the boss allowing the contents of the container to flow through the tubular section and out of an outlet in the wall, the lock means for enabling the user to lock the valve in an open position to dispense the contents unattended.

2. The perforative spout of claim 1 further comprising a protective cap for covering the cutting element.

3. The perforative spout of claim 1 further comprising an adaptor for rounded containers, the adaptor having an opening and a planar surface for mounting flush against the flange, the adaptor further having a curved surface for mounting flush against the rounded container wall.

4. The perforative spout of claim 1 wherein the cutting element is a radius cut generally hollow semi-circular housing tapering to said point, the edges of the housing defining said two edge blades for cutting the container wall.

5. The perforative spout of claim 4 wherein said at least one cross rib comprises two cross-ribs intersecting to form a 90 degree angle.

6. The perforative spout of claim 5 wherein the exterior thread means is a single angled thread, the single thread spiralling from the base of the shank to a rim of the shank.

7. The perforative spout of claim 1 wherein the unitary perforation element is molded from teflon.

8. The perforative spout of claim 1 wherein the unitary perforation element is made from a polyethylene plastic material.

9. The perforative spout of claim 1 wherein the cutting element is metal plated.

10. The perforative spout of claim 1 wherein the edge blades are metal plated.

11. The perforative spout of claim 1 wherein the edge blades are metallic.

12. The perforative spout of claim 1 wherein the flange defines one curved surface for mounting flush against a rounded container.

13. The perforative spout of claim 1 wherein the flange defines a planar surface for mounting flush against a planar container.

* * * * *